United States Patent [19]

Zlobinsky et al.

[11] Patent Number: 5,067,251

[45] Date of Patent: Nov. 26, 1991

[54] VACUUM PUMP WITH HEATED VAPOR PRE-TRAP

[75] Inventors: Yury Zlobinsky, Massapequa; Donald A. Mattes, Huntington, both of N.Y.

[73] Assignee: Savant Instruments, Inc., Framingdale, N.Y.

[21] Appl. No.: 638,627

[22] Filed: Jan. 8, 1991

Related U.S. Application Data

[62] Division of Ser. No. 514,120, Apr. 25, 1990.

[51] Int. Cl.[5] ..... F26B 5/04

[52] U.S. Cl. ..... 34/5; 34/32

[58] Field of Search ..... 34/15, 72, 79, 92, 5, 34/18, 32; 415/169.2

[56] References Cited

U.S. PATENT DOCUMENTS 4,053,990 10/1977 Bielinski ..... 34/92

4,584,781 4/1986 Parkinson et al. ..... 34/92

*Primary Examiner*—Henry A. Bennett

*Assistant Examiner*—Denise L. F. Gromada

*Attorney, Agent, or Firm*—Morrison Law Firm

[57] ABSTRACT

A heater equipped pre-trap chamber is provided at the upstream side of the inlet to a vacuum diaphragm pump so that gas products and solvent drawn from a specimen in a drying chamber can be subjected to a separation operation in the pre-trap chamber to remove liquid and readily condensable vapor forms of solvent. This thereby prevents entry of liquid solvent to the pump unit where it could cause damage. The inlet to the pump is located some distance above the outlet from the pre-trap chamber so that any liquid as may carryover in the flow from the pre-trap chambers towards the pump inlet, will return to the pre-trap as a gravity induced back flow. Solvent collected in the pre-trap chamber is heated to vaporize it and pass it out through the pump in that form to the outside atmosphere, making the pre-trap self-cleaning.

5 Claims, 2 Drawing Sheets

VACUUM PUMP WITH HEATED VAPOR PRE-TRAP

This is a division of application Ser. No. 07/514,120, filed Apr. 25, 1990.

BACKGROUND OF THE INVENTION

The present invention relates to a pump unit and a method for evacuating drying spaces wherein vacuum drying of aqueous and other solvents-containing laboratory specimens is carried out.

Certain research, testing and like procedures involve vacuum drying specimen compositions which include or are embodied in a solvent vehicle. Solvents used generally can include water, acids, organic liquids, etc. Frequently, the compositions will be as gels.

Evacuation of the space in which drying is carried out, commonly is effected with, e.g., a diaphragm pump which can be a single stage or a plural pumping stage type unit. The attendant reduction of space pressure to values well below atmospheric pressure as well as application of heat to the drying space and/or specimen, causes the solvents present to be drawn from the specimen in liquid form and also to evaporate from the specimen, both such solvent forms being drawn out of the evacuation chamber along with chamber headspace gases. The vapors of some of these solvents are readily condensable when pressure values are increased in the diaphragm pump unit which must compress the gas flow outdraw from the drying space so it can be discharged to atmosphere or subjected to a recovery processing. Liquid solvent "slugs" if drawn into the pump, can damage it and to a degree requiring replacement or rebuilding of the pump.

Where diaphragm pump units have been used in the past for this purpose, the prior art has sought to ameliorate the potential for liquid solvent presence and vapor condensation in the pump by employing, e.g., cold traps to condense liquid vapors before the gas flow enters the pump unit. But pre-trap cooling is expensive both as to initial equipment and operating cost because very low order cooling temperatures must be maintained. Also, Bell jars have been used as pre-traps, but these Bell jars have the disadvantage that they can implode under vacuum and possibly injure workers nearby. More importantly though, is that these prior used pre-traps require periodic cleaning to remove trapped solvent. To effect this cleaning, the vacuum lines must be broken, i.e., disconnected. Over a period of time this can effect integrity of the lines, but of more immediate disadvantage is that if cleaning needs be done in the middle of a drying cycle, the system vacuum level must be reestablished prolonging the overall drying period and expending energy unnecessarily. Further, prior pump unit/pre-trap arrangements allowed for solvent to condense and collect, inter alia, in hose loops and in pump inlets and outlets as well. Such condensed solvent represents a stagnant liquid mass that simply sits obstructively in the system and retards the drying action, it being especially an acute problem where the condensed solvent is in a hose loop. The hose functions as an insulator and blocks out any form of heat entry to the solvent that could vaporize same.

OBJECTS AND SUMMARY OF THE INVENTION

Accordingly, it is an object of the invention to provide a vacuum pump unit with a heated pre-trap which over comes the drawbacks of the prior art.

It is a further object of the invention to provide a vacuum pump unit with a heated pre-trap which operates to remove liquid form solvent evolved in a vacuum drying operation before this liquid solvent can enter the pump unit, thereby to substantially eliminate causes of damage to pump units as heretofore has been prevalent.

Another object is to provide a vacuum pump unit with a heated pre-trap which operates to pass all solvent from the drying system thereby eliminating need to empty pre-traps or need for breaking the vacuum system.

A still further object is to provide a method of evacuating a drying space with a diaphragm pump unit in a manner that prevents damage by liquid solvent to the pump unit, and removal of all solvent from the evacuating system to an outside environment without interrupting system operation or need to drain solvent therefrom at any location.

An additional object is to reduce drying cycle time to periods heretofore not attainable when using prior art pump/pre-trap arrangements.

Briefly stated, there is provided a heater equipped pre-trap chamber at the upstream side of the inlet to a vacuum diaphragm pump so that gas products and solvent drawn from a speciment in the drying chamber can be subjected to a separation operation in the pre-trap chamber to remove liquid and readily condensable vapor forms of solvent. The inlet to the pump is located some distance above the outlet from the pre-trap chamber so that any liquid solvent as may carry over in the flow from the pre-trap chamber towards the pump inlet, will back flow by gravity force to the pre-trap. Solvent collected in the pre-trap chamber is heated to vaporize it and pass it out through the pump in that form to the outside atmosphere, making the pre-trap self-cleaning.

In accordance with these and other objects of the invention, there is provided a vacuum pump unit for use in evacuating a drying space wherein aqueous and like solvent-containing speciments are vacuum dried, the unit comprising a diaphragm pump having an inlet thereto and an outlet therefrom. Means enclosing a space constituting a pre-trap chamber are provided, the pre-trap chamber having an inlet thereto and an outlet therefrom, said pre-trap chamber being communicatively connected with an outlet of the drying space, the outlet of the pre-trap chamber being communicated to the inlet of the pump, the pre-trap chamber being positioned below the pump inlet to an extent that a height of predetermined distance exists between the pre-trap chamber outlet and the pump inlet, the pump drawing gas products including entrained liquid and vapor forms of solvent from said drying space at below atmospheric pressure and into the pre-trap chamber, the outlet of said pre-trap chamber being sufficiently distant from the pre-trap chamber inlet that upon gas products flow entry to said pre-trap chamber, liquid form solvent gravity separates from the gas products flow and collects at the bottom of the pre-trap chamber, the gas products and any solvent vapor therein thereafter being drawn outwardly from the pre-trap chamber through its outlet and into the pump wherein pressure of the gas products flow is increased so that on discharge from the pump, pressure at the pump outlet is at or above atmospheric pressure, and heating means for maintaining the pre-trap chamber at a predetermined temperature sufficient to evaporate solvent collecting in said pre-trap so it can pass from the pre-trap into the pump in that form and thence be discharged by the pump to the outside atmosphere.

In another aspeot, the invention provides a method for vacuum drying an aqueous and like solvents-containing speciment comprising disposing the speciment in a sealable drying chamber, connecting the interior of the drying chamber to an inlet of a pre-trap chamber disposed a distance below the drying chamber so that the flow course between the drying chamber and the pre-trap inclines downwardly. The suction side of a diaphragm pump disposed a distance above the pre-trap chamber, is connected to an outlet of the pre-trap chamber in a flow course which inclines upwardly from the pre-trap chamber in the direction of the pump suction so that operation of the pump withdraws liquid and vapor solvent from the specimen along with gas products from said drying chamber and into the pre-trap chamber. Gravity separation of liquid solvent from the gas products takes place in the pre-trap chamber and the liquid solvent collects as a pool in said pre-trap chamber, with the liquid solvent pool being heated in the pre-trap chamber to vaporize solvent therefrom so it can be withdrawn through the pump in that form and discharged to an environment outside the pump.

The above, and other objects, features and advantages of the present invention will become apparent from the following description read in conjunction with the accompanying drawings, in which like reference numerals designate the same elements.

BRIEF DESCRIPTION OF THE DRAWINGS

The invention will appear more clearly from the detailed description when taken in conjunction with the accompanying drawing in which.

DETAILED DESCRIPTION OF THE PREFERRED EMBODIMENT

The present invention deals with a vacuum pump with heated pre-trap used for evacuating a vacuum drying space wherein drying of aqueous and other solvents-containing specimens are to be vacuum dried. One class of such samples are those which are to be dried as a adjunct to electrophoresis analysis. The specimens can contain a wide range of solvents inclusive of water, chemical solvents, acids etc. Desirably, these solvents are to be separated from the gas stream prior to the point where they, in liquid or readily condensable vapor form, can make entry into the vacuum pump wherein as liquid masses, same could seriously damage the pump components.

Figure 1:
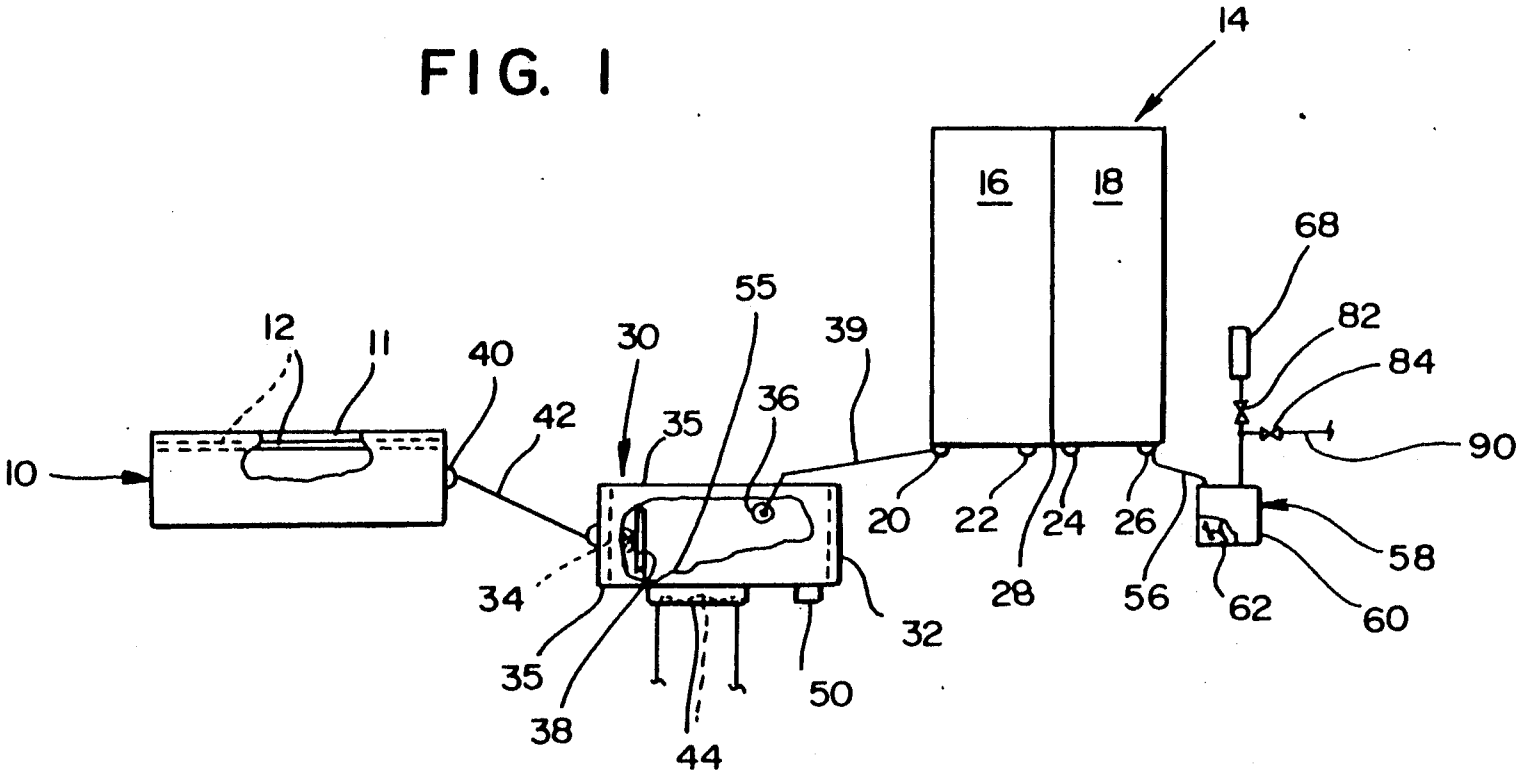
FIG. 1 is a schematic side view depiction of a vacuum pump unit and heated vapor pre-trap constructed in accordance with the principles of the present invention, portions thereof being broken away to facilitate understanding of the invention.

Referring now to FIG. 1, vacuum dryer chamber 10 is a sealable structure in which a specimen 12 can be placed, the specimen being "wet', i.e., constituted as a liquid form solvents-containing composition which must be vacuum dried to remove the solvents therefrom. More often than not, the specimens will be in a gel form. The depicted dryer chamber 10 is that of a Savant Gel Dryer Model SGD-4050, the specimen being in a slab gel form, that slab being supported at the top of the dryer structure and overlaid with a silicone rubber mat 11 to effect sealing of the chamber, there being a heater(not shown) in the dryer structure. Such drying can and will be effected over a period of time, e.g., about one-quarter to several hours or more, depending on the particular composition involved. During the vacuum drying cycle, the specimen generally (but not in all cases essentially) will be heated to accelerate the drying time.

The vacuum pump unit shown generally at 14, is depicted by way of example, as being a two-stage diaphragm pump. It will be apparent to one of ordinary skill in the art upon the reading hereof, that the invention has applicability and use with both single and plural stage diaphragm pumps. Commonly, single pumping stages will be employed where drying can be achieved with vacuum levels down to about 20 inches. Where need for vacuum levels of about 29 inches exists, two or more diaphragm pumping stages pumps will be used.

Pump unit 14 is comprised of a first pumping stage section 16, and a second pumping stage section 18, the two sections being mounted as an integrated structure along with an electric drive motor(not shown), controller, base support parts etc. One such pump unit suited to the purpose is a VACUUBRAND Model MZ ZHC vacuum pump manufactured by VACUUBRAND GmbH & Co. of Wertheim, Federal Republic of Germany, the inlet/outlet arrangements of that pump being modified to locate same at the bottom part of the pump structure to thereby render the pumping stages self-draining. The first pumping stage 16 has an inlet thereto as at 20, and an outlet as at 22, the second pumping stage 18 similarly having an inlet 24 and an outlet 26. The outlet 22 of pumping stage 16 is communicated to the inlet of stage 18 as at 28. Since the solvents handled by the pump are in many cases of corrosive nature, all the interior parts of the pump are of an inert material or are coated with such material, polytetrafluoroethylene being exemplary of such inert material.

Figure 2:
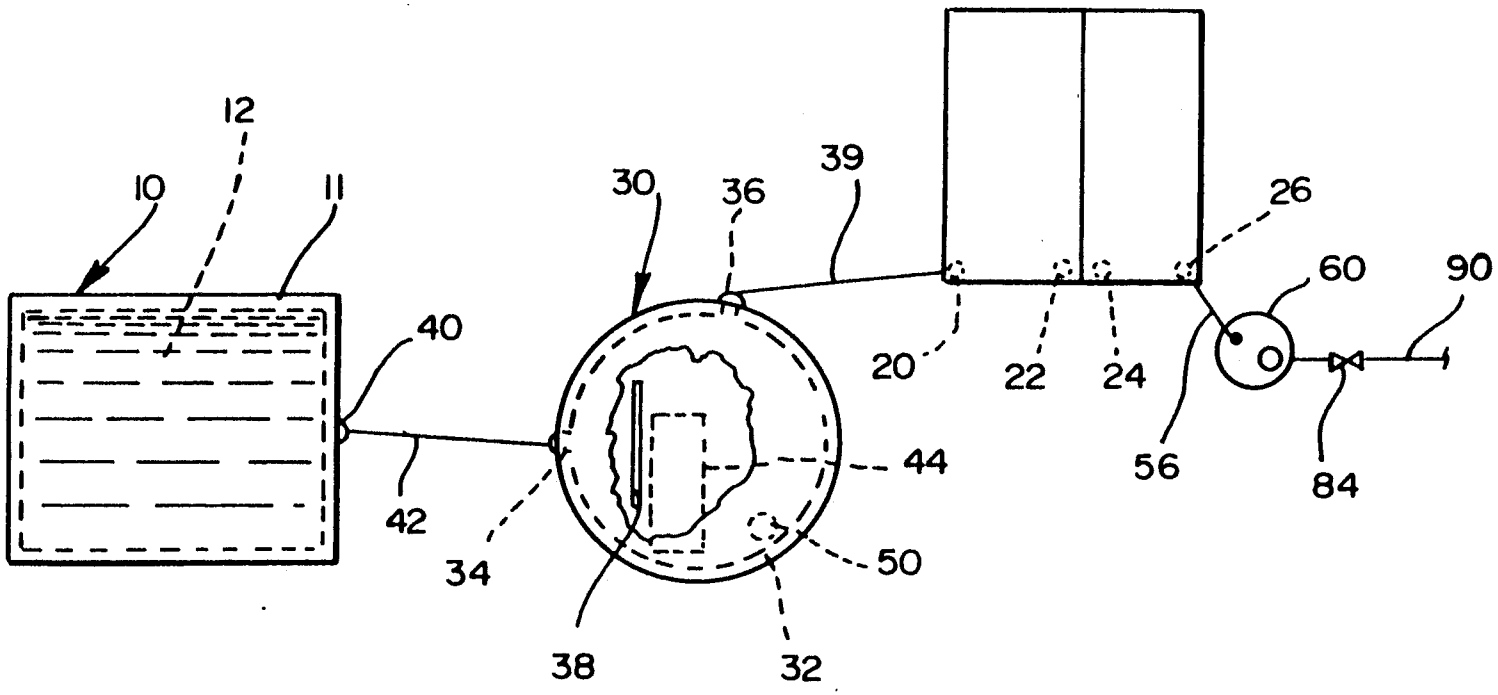
FIG. 2 is a schematic top plan view depiction of the vacuum pump unit shown in FIG. 1.

Although the pre-trap chamber 30 is depicted schematically in FIGS. 1 and 2 for purposes of illustrating respective elevational positioning thereof with respect to the pump unit, it will be understood that in actual embodiment, the pre-trap chamber is mounted in fixed position on and as part of the integrated structure of the vacuum pump unit 14, the pre-trap chamber being fixed under the pump stages and having an enclosure or housing in which the chamber shell is housed, this housing embodying support feet on which the entire assembly sits, as for example, on top of a laboratory workbench. The pre-trap chamber is comprised of a cylindrically-configured, thickened shell 32 closed off with head plates 35, and having an inlet as at 34 and an outlet at 36, this outlet being some distance away from the inlet and faced orthogonally relative to the inlet so that it is situate remote and relatively inaccessible to the direct entry flow course of gas products entering from the dryer 10 as will be explained in more detail shortly. A baffle plate 38 can be fixed in the shell 32 a short distance inwardly of the shell inlet 34 and have an appreciable lateral expanse as can be seen from FIG. 2, but with the baffle having clearance space at the top, bottom and sides thereof so that liquid solvent which separates from the flow into the shell, can freely pool within the full expanse of the lower part of the chamber as will be explained later. Shell inlet 34 is communicated to the outlet 40 of the drying chamber 10 by means of tubing 42, the disposition of the drying chamber 10 being made such as to position the outlet 40 above shell inlet 34 thereby establishing a drain path incline in tubing 42 toward the pre-trap for the liquid solvent passing thereto from the drying chamber.

The pre-trap chamber 30 is fitted with an electric resistance-heater 44, the heater being, for example, mounted at the underside of the shell but in close, good thermally conductive contact therewith so that heat transfer into liquid form solvent collected in the chamber readily can be fulfilled to evaporate the solvent during the course of the specimen drying cycle. A thermostat 50 also is provided at the shell underside to insure thermal control of the heater to the purpose of maintaining during the drying cycle, a substantially constant temperature within the shell. Generally, the temperature within shell 32 will be one in the range 50–100 degrees C., and most usually one in the range about 65–72 degrees C. varying to some extent within the expressed ranges depending on specimen composition.

Outlet 36 of shell 32 is at least at or slightly above the level of the shell inlet 34 and that outlet is connected to inlet 20 of pumping stage 16 by means of tubing 39, the tubing having a major length part inclined downwardly from the direction of inlet 20 so that the tubing 39 is self-draining as to any liquid solvent present therein from carry over from the shell or constituted by a solvent vapor which has condensed in the tubing. The inclining of tubing 39 and tubing 42, and at outlet from the second pumping stage 18 to provide draining of liquid solvent not only represents pump diaphragm protection from damage, but also serves to obviate pooling of liquid in the drying system in a manner as retards drying.

The outlet 26 of the second pumping stage 18 is communicated by tubing 56 to a treatment chamber member 58, this unit comprising a closed cup 60 which can be filled with a solvents treating material 62. Solvent material passing out in the pump discharge is treated to absorb same in the material or otherwise neutralize and render innocuous solvent substance so that the discharge can be outletted to laboratory spaces and the like if desired. This is of particular importance in terms of disposing of what otherwise would be noxious or possibly harmful substances in the immediate vicinity of work stations and the personnel present there. For example, where acids are used as solvent and their components a substance of ultimate discharge, limestone present in the collector cup can be used, e.g., to neutralize same to a salt and water and remove disagreeable odor associated with a given acid. Other disposal paths or conveyance courses of pump discharge to a recovery operation can of course, be employed and particularly where hazardous products are involved. For example, by closing valve 82 leading to muffler 68 and opening valve 84, discharge from the pump can pass via line 90 to a recovery operation (not shown). The advantage of work station discharge, where possible, is elimination of costly and sometimes obstructive vent pipe systems. For discharge of gas products to the work space, the muffler unit 68 can be mounted on the separator to sound deaden this discharge.

Further understanding of the invention will be had by reference to the now given description of pump unit operation for evacuating the drying space 10. Solvents-containing specimen 12 is introduced into drying chamber 12, the chamber is sealed and the vacuum pump unit 14 is started to initiate the vacuum drying process. Heat application to the specimen to hasten drying generally will be observed. There is initially and particularly where gel drying is involved, a surge of liquid solvent drawn from the space 10. This liquid form solvent should be barred entry to the pump unit and this is achieved as noted next.

To counter the drawback of solvent liquid presence in the gas stream and reduce or eliminate it, the products issuing from chamber 10 through tubing 42, enter the pre-trap in a flow which inherently results in separation of liquid solvent from the flow. Separation can be enhanced by allowing the flow to impinge against baffle plate 38. This impacting flow of the products further works to effect separation of liquid form solvent from the gas stream and it gravity falls within the pre-trap chamber to accumulation as a liquid pond or pool 55 at the bottom of the chamber 30. The gas stream and any solvent vapor entrained therewith, passes on in the pre-trap chamber toward and out the outlet 36. Outlet 36 is located some distance away from the inlet to the chamber and in a different facing orientation than the inlet so that liquid solvent flow into the pre-trap chamber has lessened possible access to the outlet opening 40.

Flow from the pre-trap chamber passes through tubing 39 connecting outlet 36 with inlet 20 to the first pumping stage 16. This tubing it will be noted is inclined between the locations of outlet 36 and inlet 20 to provide a liquid back flow path to the pre-trap chamber so that any solvent liquid carryover can gravity feed back to the solvent pool. Inlet 20 is located a predetermined distance above outlet 36. In the depicted pump, the distance is about 2 to 2 ½".

The gas stream passing into the pumping stage 16 is pressurized to an intermediate pressure below atmospheric pressure, and then flows out of pumping stage 16 into pumping stage 18 where further pressurization to atmospheric pressure level will take place. However, because of the prior removal in the pre-trap of liquid solvent, any remaining presence of same in the gas stream is as vapor and will not cause damage to the pump unit.

The vacuum pump pre-trap arrangement of the invention provides a number of important advantages over prior arrangements. For one thing, the pre-trap chamber and consequently, its outlet 36 are physically positioned some distance below the inlet to pumping stage 16. This deters liquid solvent accessing to the pumping stage since during the separation in the pre-trap chamber, the liquid solvent gravity feeds to collection as a pool well before any intake momentum therein can carry it to the vicinity of the chamber outlet. In prior art pre-traps such as a Bell jar, the inlet and outlet of the pre-trap generally are located at top of the jar and the flow courses include loops wherein liquid can pool and retard drying. The invention provides that the tubes connecting the pre-trap outlet to the diaphragm pump inlet is inclined upwardly in the direction of the pump inlet so that liquid carryover can flow back to the pre-trap. Similarly, the drying chamber outlet is located above the pre-trap inlet so there is always drain toward the pre-trap chamber in the tubing.

Additionally, the pre-trap provided by the invention embodies a heater therein so that collected solvent in the pool is vaporized in a manner as inhibits liquid form solvent escape from the pool in favor of the vapor form, and further the evaporation of the pool during the drying cycle renders the system self-cleaning. All solvent present in the specimen is removed therefrom and all solvent passes through the pump unit and out of the system. There is no need to break any tubing connection anywhere as a requirement for cleaning the system and there is no need to drain the pre-trap. This is done as part of the drying operation itself. All points where liquid can accumulate to detriment of the drying operation are eliminated in favor of inlets, outlets and tubing course runs which are self-draining. Lastly and since there are no liquid stagnation points, faster drying and enhanced pump performance are provided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for vacuum drying an aqueous and like solvents-containing specimen which comprises disposing the specimen in a sealed drying chamber, connecting the interior of the drying chamber to an inlet to a pre-trap chamber disposed a distance below the drying chamber so that the flow course between the drying chamber and the pre-trap inclines downwardly, connecting the suction side of a vacuum diaphragm pump disposed a distance above the pre-trap chamber to an outlet of said pre-trap chamber in a flow course which inclines upwardly from said pre-trap chamber outlet in the direction of said pump suction side so that operation of said pump withdraws liquid and vapor solvent from said specimen along with gas products from said drying chamber as a flow into said pre-trap chamber, gravity separating liquid solvent from the gas products in said pre-trap chamber and collecting said liquid solvent as a pool in said pre-trap chamber, and heating the liquid solvent in said pre-trap chamber to vaporize same so that it can be withdrawn through the pump in that form and discharged to an environment outside said pump.

2. A method in accordance with claim 1 in which the specimen is heated in said drying chamber during the drying operation, temperature in said pre-trap chamber being maintained higher than that in said drying chamber.

3. A method in accordance with claim 2 in which the temperature at which the pre-trap chamber is maintained is one in a range between about 50 degrees C. and about 100 degrees C.

4. A method in accordance with claim 3 in which the temperature at which the pre-trap chamber is maintained is one in a range between about 65 degrees C. and about 72 degrees C.

5. A method in accordance with claim 1 in which the solvent and gas products flow into said pre-trap chamber is following entry to said chamber impacted against a surface within said pre-trap chamber thereby to enhance separation of liquid solvent from the gas products.

* * * * *